US005336447A

United States Patent [19]

Clements

[11] Patent Number: 5,336,447

[45] Date of Patent: Aug. 9, 1994

[54] PROCESS AND COMPOSITION FOR TREATING FABRICS

[75] Inventor: Anthony H. Clements, Cefn-y-Bedd, Wales

[73] Assignee: Lever Brothers Company, Division of Conopco, Inc., New York, N.Y.

[21] Appl. No.: 77,888

[22] Filed: Jun. 15, 1993

Related U.S. Application Data

[63] Continuation of Ser. No. 797,518, Nov. 22, 1991, abandoned.

[30] Foreign Application Priority Data

Nov. 30, 1990 [GB] United Kingdom ..... 9026050.6

[51] Int. Cl.[5] ..... C11D 3/42; C11D 3/28; D06L 3/12

[52] U.S. Cl. ..... 252/554; 252/8.6; 8/617; 8/671

[58] Field of Search ..... 252/8.6–8.9, 252/554; 8/617, 671

[56] References Cited

U.S. PATENT DOCUMENTS

| | | | |
|---|---|---|---|
| 3,726,815 | 4/1973 | Grand | 252/544 |
| 3,862,045 | 1/1975 | Sato et al. | 252/8.75 |
| 3,875,071 | 4/1975 | Grand | 252/544 |
| 4,291,071 | 9/1981 | Harris et al. | 252/8.75 |
| 4,294,711 | 10/1981 | Hardy et al. | 252/8.8 |
| 4,764,176 | 8/1988 | Sakamoto | 8/442 |
| 4,772,404 | 9/1988 | Fox et al. | 252/8.8 |
| 4,919,848 | 4/1990 | Harnisch | 252/600 |
| 4,950,304 | 8/1990 | Reinert et al. | 8/566 |

FOREIGN PATENT DOCUMENTS

| | | |
|---|---|---|
| 2916656 | 11/1980 | Fed. Rep. of Germany . |
| 8602392 | 4/1986 | PCT Int'l Appl. . |
| 2174731 | 11/1986 | United Kingdom . |

OTHER PUBLICATIONS

JP 61,086,933–Derwent Publication AN 86/153,111 (Lion) 1986 No month available.

*Primary Examiner*—Paul Lieberman
*Assistant Examiner*—Michael P. Tierney
*Attorney, Agent, or Firm*—A. Kate Huffman

[57] ABSTRACT

A process and composition for treating fabrics or textiles to help restore and/or prevent changes in hue brought about by fluorescer agent absorption on fabrics or textiles.

In one aspect, the composition comprises a quenching agent and a detergent active.

6 Claims, No Drawings

PROCESS AND COMPOSITION FOR TREATING FABRICS

This is a continuation application of Ser. No. 07/797,518, filed Nov. 22, 1991, now abandoned.

This invention relates to a process and composition for treating fabrics or textiles to help to restore and/or prevent changes in hue brought about by fluorescer agent absorption on fabrics or textiles.

Fluorescer agents or optical brighteners as they are sometimes known are a common component in heavy duty detergent formulations intended for washing fabrics or textiles since the fluorescer, by absorbing invisible ultraviolet light and re-emiting blue or green visible light masks the undesirable yellow tint of textiles or fabrics and thus brightens them. Thus fabrics or textiles treated with fluorescers appear whiter and more attractive to the consumer.

A disadvantage of fluorescer agents is however that undesirable absorption of fluorescer onto coloured fabrics can cause those coloured fabrics to change hue. In the context of the present invention by changes in hue is meant a change in shade or depth or colour. This is most noticeable when for example one part of a suit is fluorescent agent damaged or napkins but not the tablecloth of a dining set are fluorescent agent damaged. The effect is also particularly noticeable on pastel shades.

The undesired absorption of fluorescent agents usually occurs by one or both of two routes. The first is where coloured fabrics or textiles are washed with a detergent composition comprising fluorescent agents and the second is where coloured fabrics are washed with fabrics already having fluorescent agent absorbed on their surfaces and transfer occurs.

In the past there have been attempts to solve this problem of undesired fluorescent agent absorption by preventing the absorption for example by using a detergent composition without fluorescent agent or by removing the fluorescent agent from the solution. For example DE 2 916 656A (Henkel) discloses an optical brightener free detergent composition comprising alkyl-pyridinium salts to remove optical brighteners from solution.

These proported solutions are not satisfactory because even if the detergent composition contains no fluorescent agent, articles in the wash load previously treated with fluorescent agent can give rise to transfer and because the choice of compatible detergent actives for these compositions is limited.

An alternative approach to solving the problem has been to attempt to mask the fluorescent agent once it has been absorbed on the coloured fabric.

Such a solution is proposed for industrial, synthetic textile pretreatment or after treatment in GB 2 174 731A (Sandoz Ltd) where the textile is brought into contact with a UV-absorber which is then fixed on the textile. The UV-absorber is in competition for UV light with the fluorescent agent and thus in theory will reduce re-emmission by the fluorescent agent in the visible spectrum.

A similar solution is proposed in EP 0 310 083A (Ciba-Geigy).

The disadvantage of this approach is that relying on a UV-absorber alone to mask the fluorescent agent requires a high level of UV absorber to be deposited on the textile in order to compete effectively for UV-light.

The present invention seeks to provide a process and a composition for treating fabrics and textiles which restore original colour and/or prevent changes in hue brought about by fluorescent agent absorption on fabrics or textiles.

We have now found that the undesirable effect of fluorescent agents on textiles or fabrics can be masked not only by the UV-absorber mechanism but also by the formation of a complex which prevents the agent re-emitting in the visible spectrum. In the present invention the reduction or prevention of re-emission of light by a fluorescent agent is termed quenching and the agent which achieves quenching is termed a quenching agent. Quenching agents can achieve quenching either by a process of UV-absorption, or by a process of complexation or both.

Certain quenching agents are known from the paper industry for example as disclosed in GB 1 490 077, U.S. Pat. No. 4,695,405, U.S. Pat. No. 3,542,642, FR 2 004 010, GB 2 066 317 and EP 217 256 for quenching fluorescent agents on recycled paper. Certain quenching agents are also known for application to textiles as part of an industrial treatment process from GB 2 178 076A. The compositions described therein are well-adapted for direct application to textile fibres for example by padding.

Accordingly, a first aspect of the present invention provides a fabric or textile treatment composition comprising:

(i) a quenching agent, and (ii) a detergent active, preferably nonionic.

A second aspect of the invention provides a fabric or textile treatment composition comprising (i) a quenching agent, and (ii) a water in-soluble fabric softener.

Accordingly, a third aspect of the invention provides a process for the treatment of a fabric or textile to restore original colour and/or prevent changes in hue caused by fluorescent agents comprising the steps of contacting the fabric or textile with a composition comprising a quenching agent and a detergent active.

The process may be carried out as part of a domestic laundering process i.e. as part of the wash step or as part of the rinse step, or as a separate treatment.

The quenching agents suitable for use in the process and composition of the invention are cationic species for example Cartarex 2L or Cartarex 2LZP polyimidazoline compound ex Sandoz of Formula I and a naphthalene peridicarboxylic acid imide ex Bayer (as described in DE 3535496 of Formula II). Other quenching agents are described in EP 217256.

I

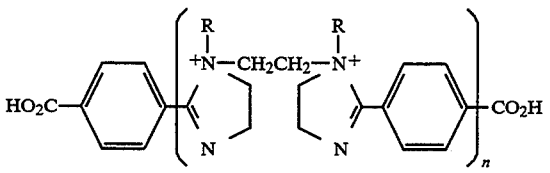

where R is $CH_3$ in Cartarex 2L or H in Cartarex 2LZP

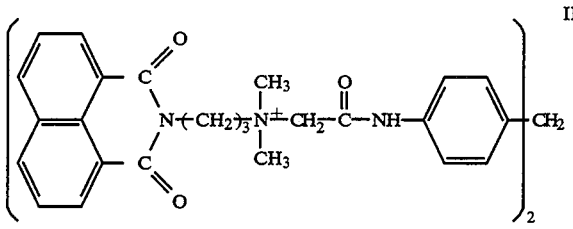

II

The amount of quenching agent to be employed in the composition of the invention is preferably from 0.01 to 60% by weight of the composition, more preferably from 0.05 to 20% by weight, most preferably from 0.1 to 10%.

It has been found that the process of the invention is particularly convenient when carried out as part of the rinse step of the laundering process, the quenching agent being part of a composition comprising ingredients normally associated with rinse conditioners.

The compositions according to the invention can contain one or more detergent active materials, selected from soaps, non-soap anionic, nonionic, zwitterionic and amphoteric synthetic detergent active materials, cationic, nonionic, zwitterionic and amphoteric fabric softening materials and optionally one or more fabric softening materials. Nonionic materials are especially useful in the context of the present invention.

Many suitable detergent compounds are commercially available and are fully described in the literature, for example in "Surface Active Agents and Detergents", Volumes I and II, by Schwartz, Perry and Berch.

Suitable nonionic compounds which may be used include in particular the reaction products of compounds having a hydrophobic group and a reactive hydrogen atom, for example aliphatic alcohols, acids, amides or alkyl phenols with alkylene oxides, especially ethylene oxide either alone or with propylene oxide. Specific nonionic detergent compounds are alkyl ($C_6$–$C_{22}$) phenols—ethylene oxide condensates, generally up to 25 EO, i.e. up to 25 units of ethylene oxide per molecule, the condensation products of aliphatic ($C_8$–$C_{18}$) primary or secondary linear or branched alcohols with ethylene oxide, generally up to 40 EO, and products made by condensation of ethylene oxide with the reaction products of propylene oxide and ethylenediamine. Other so-called nonionic detergent compounds include alkyl polyglycosides, long tertiary amine oxides, long chain tertiary phosphine oxides and dialkyl sulphoxides.

Amounts of amphoteric or zwitterionic detergent compounds can also be used in the compositions of the invention but this is not normally desired due to their relatively high cost. If any amphoteric or zwitterionic detergent compounds are used it is generally in small amounts. Since the quenching agents useful in the present invention are cationic, any anionic detergent compounds are used in small amounts.

Suitable fabric softening compounds may for instance be selected from cationic fabric softening materials and nonionic fabric softening materials. Suitable materials include substantially water-insoluble quaternary ammonium compounds such as for instance disclosed in EP 89200545.5 and EP 239 910, amine materials, amphoteric fabric conditioning materials as disclosed in EP 89200545.5, clays, polysiloxanes as disclosed in EP 150 867 (Procter and Gamble Co.) and nonionic cellulose ethers as disclosed in EP 213 730 (Unilever).

The effective amount of the detergent active or fabric softening compound or compounds used in the composition of the present invention is generally in the range of up to 50%, preferably up to 40% by weight, most preferably not more than 30% by weight of the composition. Preferably the level is above 1%, more preferred more than 2%.

Detergent compositions of the invention may include detergency builder to improve the efficiency of the detergent active, in particular to remove calcium hardness ions from the water and to provide alkalinity. The builder material may be selected from inorganic precipitating builders materials (such as alkali metal carbonates, bicarbonates, borates, orthophosphates and silicates), sequestering builder materials (such as alkali metal pyrophosphates, polyphosphates, amino polyacetates, phytates, polyphosphonates, aminopolymethylene phosphonates and polycarboxylates), ion-exchange builder materials (such as zeolites and amorphous alumino-silicates), organic precipitating builder materials (such as those having the formula (I):

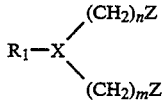

wherein: $R_1$ is $C_{10}$–$C_{24}$ alkyl or alkenyl, or an arylalkyl or alkylaryl group of equivalent chain length; X is CH, $CR_2$, N or CON; $R_2$ is $C_1$–$C_3$ alkyl; Z is COOY or $SO_3Y$; Y is hydrogen or a solubilising cation, preferably alkali metal and especially sodium; and n and m, which may be the same or different, are 0 or integers from 1 to 4, or mixtures of any one or more of these materials. Preferred examples of builder materials include sodium tripolyphosphate, mixtures thereof with sodium orthophosphate, sodium carbonate, mixtures thereof with calcite as a seed crystal, sodium citrate, zeolite and the sodium salt of nitrili- triacetic acid.

The level of such builder material in the compositions of the invention may be up to 80% by weight, preferably from 20% to 70% by weight and most preferably from 30% to 60% by weight.

Detergent compositions according to the invention preferably are alkaline, in that they yield a pH of more than 8.0 when added to water at a concentration of 1% by weight at 25° C.

Apart from the components already mentioned, a detergent composition of the invention can contain any of the conventional additives in the amount in which such additives are normally employed in fabric washing detergent compositions. Examples of these additives include additional fabric softening agents. We have found particularly beneficial effects when the fabric softening agent is a mixture of organic precipitating builder and either a cationic fabric softening agent or a fatty amine. Other optional additives include the lather boosters such as alkanolamides, particularly the monoethanolamides derivatives from palm kernel fatty acids and coconut fatty acids, lather depressants, oxygen-releasing bleaching agents such as sodium perborate and sodium percarbonate, peracid bleach precursors, chlorine-releasing bleaching agents such as tricloroisocyanuric acid, inorganic salts such as sodium sulphate, and, usually present in very minor amounts, dye fixing agents, perfumes including deodorant perfumes, enzymes such as cellulases, proteases and amylases, germicides and colourants.

The compositions may be in any convenient form such as bars, powders, pastes or liquids which may be aqueous or non-aqueous and structured or unstructured.

The detergent compositions may be prepared in any way appropriate to their physical form such as by dry-mixing the components, co-agglomerating them or dispersing them in a liquid carrier. The fabric softening agent may be incorporated as such or it may be incorporated in the form of particles. The quenchim q agent may be incorporated in liquid or solid form.

Compositions of the present invention which are specifically suitable for use in the rinse preferably comprise from 1 to 70% of a fabric softening material.

For use in the rinse cycle of the fabric laundry process, compositions of the present invention are preferably liquid and comprise an aqueous base, which may constitute from 5 to 97% by weight of the composition.

The pH of fabric softening compositions for use in the rinse is preferably less than 8.0 when added to water at a concentration of 1% by weight of the composition.

Compositions of the present invention which are suitable for use in the tumble dryer preferably comprise from 30% to 80% of quenching agent and from 20% to 70% of fabric softening material.

The invention will now be illustrated in the following non-limiting examples.

EXAMPLES

EXAMPLE 1

Samples of mercerised cotton calico were taken and dyed with 0.75% by weight of Anthrasol pink IR (ex Hoechst). Where appropriate the pink cotton was 'damaged' by washing with a heavy duty domestic main wash powder—Persil Automatic which comprised 0.3% Tinopal DMS fluorescer. The wash conditions were tergotometer (100 rpm) at 40° C. for 30 minutes in 18° hard water using a cloth to liquor ratio of 1:40. Rinsing was also carried out in a tergotometer using a cloth to liquor ratio of 1:40.

The fluorescence of the samples was calculated by measuring reflectance from the samples at 460 nm using an Elrepho-reflectometer with and without a UV filter on the incident light. The fluorescence (F) is then the difference between these reflectance values.

Samples of pink, fluorescer damaged cotton were treated with a 2.8 g/l aqueous solution of a typical rinse conditioner formulation to which various levels of quenching agent were added. The treatment was carried out at 25° for 10 minutes. The formulation was as follows:

| | Parts by weight |
|---|---|
| Arquad 2HT* | 4.8 |
| Fatty Acid (Pristerine 4916) | 0.5 |
| Water | 93 |
| Isopropanol | 1.2 |
| Orthophosphoric Acid | 0.018 |
| Sodium Chloride | 0.01 |
| Perfume | 0.23 |
| Minors | 0.0737 |

| Level of Quenching Agent g/l | F Value Cartarex 2L Formula I | F Value Quenching Agent Formula II |
|---|---|---|
| 0 | 13.5 | 13.5 |
| 0.05 | 6.7 | 2.6 |
| 0.5 | 4.4 | — |
| 0.75 | 3.9 | — |
| 0.8 | — | 0.8 |

*A quaternary ammonium compound used as a fabric softener ex Armour Hess.

These results show that compositions according to the invention reverse the effect of fluorescent agent damage on fabrics.

EXAMPLE 2

Samples of pink, fluorescer damaged cotton prepared as in Example 1 were treated with 5 g/l of liquid main wash detergent composition in aqueous solution to which was added various levels of quenching agent. The wash was carried out at 40° C. for 30 minutes.

The formulation was as follows:

| | Parts by Weight |
|---|---|
| Synperonic A7* | 20 |
| Dimethylditallow ammonium chloride | 2 |
| Ethanol | 6 |
| Propylene glycol | 5 |
| Borax | 1.5 |
| Alcalase | 0.49 |
| Preservative | 0.0067 |
| Perfume | 0.25 |
| Water | 64 |

| Level of Quenching Agent g/l | F Value Cartarex 2L Formula I | F Value Quenching Agent Formula II |
|---|---|---|
| 0 | 11 | 11 |
| 0.005 | — | 6.8 |
| 0.01 | — | 5.3 |
| 0.025 | 6 | — |
| 0.25 | 6.2 | 0.7 |
| 0.5 | 4.0 | 0.8 |
| 1.0 | 3.4 | 0.5 |

*A nonionic detergent active ex ICI.

These results show that compositions according to the invention reverse the effect of fluorescent agent damage on fabrics.

EXAMPLE 3

Samples of pink, fluorescer damaged cotton prepared as in Example 1 were treated with 4 g/l of an industrial detergent composition (used for washing fabrics in hotels, hospitals, etc.) in aqueous solution to which was added various levels of quenching agent of formula II. The wash was carried out at 60° C. for 20 minutes.

The formulation was as follows:

| | Parts by weight |
|---|---|
| Sodium tripolyphosphate | 20.1 |
| sodium metasilicate | 28.0 |
| sodium sulphite | 28 |
| sodium carbonate | 16.3 |
| sodium carboxymethyl cellulose (75%) | 1.5 |
| alkylphenol 6EO | 3.0 |
| primary alcohol ethoxylate 3EO | 3.0 |
| perfume | 0.1 |

| Level of Quenching Agent g/l | F Value Quenching Agent Formula II |
|---|---|
| 0 | 17.6 |
| 0.125 | 4.2 |
| 0.25 | 2.4 |
| 0.5 | 1.1 |

-continued

| | |
|---|---|
| 1.0 | 0.5 |

These results show that compositions according to the invention reverse the effect of fluorescent agent damage on fabrics,

EXAMPLE 4

Samples of white fluorescent cotton damaged with Tinopal CBS-X fluorescer to give an F value of 21.2 were washed with samples of pink undamaged cotton as prepared in Example 1, The pink and white samples were used in a 1:4 weight ratio, The wash conditions were 40° C. for 30 minutes in 1 g/l of the detergent formulation of Example 2 and various levels of Quenching agent of formula II.

| Level of Quenching Agent, Formula II g/l | F value of Pink Samples |
|---|---|
| 0 | 7.8 |
| 0.005 | 6.4 |
| 0.01 | 5.8 |
| 0.02 | 2.1 |
| 0.03 | 1.6 |
| 0.04 | 1.0 |

These results show that compositions according to the invention prevent damage by fluorescent agent transfer from damaged fabrics included in the wash load,

EXAMPLE 5

Samples of pink fluorescer-damaged cotton prepared as in example 1 were treated with 5 g/l of liquid main wash detergent composition (Formulation A or B) in aqueous solution at 40° C. for 30 minutes.

| | Parts by weight |
|---|---|
| Synperonic A7 | 20 |
| Dimethyl ditallow ammonium chloride | 2 |
| Ethanol | 6 |
| Propylene glycol | 5 |
| Borax | 1.5 |
| Alcalase | 0.49 |
| Preservative | 0.0067 |
| Perfume | 0.25 |
| Water | 64 |
| Quencher | x |

| | Quencher | x |
|---|---|---|
| Formulation A | Cartarex 2L (Formula I) | 2.5 |
| Formulation B | Formula II | 0.4 |

| | F Value |
|---|---|
| before wash | 14 |
| after wash with formulation A | 4.6 |
| after wash with formulation B | 3.3 |

EXAMPLE 6

Samples of pink fluorescer damaged cotton were treated with a 1 g/l aqueous solution of a typical rinse souring agent to which various levels of quenching agents were added. The treatment was carried out at 25° C. for 3 minutes. Rinse souring agents are used in industrial rinsing processes to neutralise excess alkali carried over from the wash.

The rinse souring agent consisted of 30% acetic acid in water.

| | F value |
|---|---|
| Level of Quenching Agent (formula I) g/l | |
| 0 | 13.7 |
| 0.1 | 8.5 |
| 0.2 | 7.3 |
| 0.4 | 6.2 |
| 1.0 | 5.2 |
| 2.0 | 4.4 |
| Level of Quenching Agent (formula II) g/l | |
| 0 | 13.7 |
| 0.005 | 13.5 |
| 0.01 | 11.9 |
| 0.02 | 11.3 |
| 0.04 | 7.8 |
| 0.08 | 4.1 |

EXAMPLE 7

Samples of pink fluorescer damaged cotton prepared as in Example 1 were treated with a 1 g/l aqueous solution of a typical reducing rinse formulation (consisting of 40% sodium metabisulphate in water) plus various levels of quenchers. Reducing rinses are used in industrial rinsing processes to decompose excess hypochlorite remaining on fabrics after washing with a heavy duty detergent compositions.

| | F value |
|---|---|
| Level of Quencher I (g/l) | |
| 0 | 15.5 |
| 0.025 | 10.3 |
| 0.05 | 7.3 |
| 0.1 | 5.7 |
| 0.25 | 4.3 |
| 0.5 | 3.8 |
| Level of Quencher (II) (g/l) | |
| 0 | 15.5 |
| 0.005 | 14.6 |
| 0.01 | 14.1 |
| 0.02 | 12.5 |
| 0.04 | 7.4 |
| 0.08 | 3.3 |

I claim:

1. A fabric or a textile treatment composition comprising:

(a) 0.01 to 60 wt. % of a quenching agent of formula

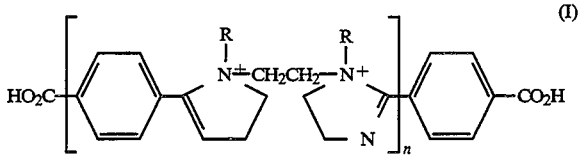

where n is about 20; and b. 1 to 50 wt. % of a detergent active selected from the group consisting of a soap, a non-soap anionic detergent material, a nonionic detergent material, a zwitterionic synthetic detergent material, an amphoteric synthetic detergent material, a cationic fabric softening material, a nonionic fabric softening material, a zwitterionic fabric softening material, an amphoteric softening material, and mixtures thereof.

2. The composition according to claim 1, further comprising 20–70 wt. % of a builder selected from the group consisting of an inorganic precipitating builder material, a sequestering builder material, an ion-exchange builder material, an organic precipitating builder material and mixtures thereof.

3. The composition according to claim 2, wherein the builder material is selected from the group of sodium tripolyphosphate, sodium orthophosphate, sodium carbonate, calcite, sodium citrate, zeolite, a sodium salt of nitrili-triacetic acid and mixtures thereof.

4. A process for the treatment of a textile comprising the steps of:

(a) providing a composition comprising (i) 0.01 to 60 wt. % of a quenching agent of formula where n is about 20;

(ii) 1 to 50 wt. % of a detergent active selected from the group consisting of a soap, a non-soap anionic detergent material, a nonionic detergent material, a zwitterionic synthetic detergent material, an amphoteric synthetic detergent material, a cationic fabric softening material, a nonionic fabric softening material, a zwitterionic fabric softening material, an amphoteric fabric softening material, and mixtures thereof; and b. contacting a fabric or textile with the composition of step (a) to restore original color or to prevent hue changes of the fabric or textile to be washed in the presence of a fluorescent agent.

5. A process according to claim 4 wherein the composition further comprises 20–70 wt. % of a builder selected from the group consisting of an inorganic precipitating builder material, a sequestering builder material, an ion exchange builder material, an organic precipitating builder material and mixtures thereof.

6. A process according to claim 5 wherein the builder material is selected from the group of sodium tripolyphosphate, sodium orthophosphate, sodium carbonate, calcite, sodium citrate, zeolite, a sodium salt of nitriltriacetic acid and mixtures thereof.

* * * * *